US006229411B1

(12) United States Patent
Mann

(10) Patent No.: US 6,229,411 B1
(45) Date of Patent: May 8, 2001

(54) INTEGRAL WAVEGUIDE STRUCTURE AND SEMICONDUCTOR WAFER

(75) Inventor: Christopher Mann, Farringdon (GB)

(73) Assignee: Council for the Central Laboratory of the Research Councils, Oxfordshire (GB)

( * ) Notice: Subject to any disclaimer, the term of this patent is extended or adjusted under 35 U.S.C. 154(b) by 0 days.

(21) Appl. No.: 09/117,781

(22) PCT Filed: Feb. 14, 1997

(86) PCT No.: PCT/GB97/00424

§ 371 Date: Aug. 6, 1998

§ 102(e) Date: Aug. 6, 1998

(87) PCT Pub. No.: WO97/30488

PCT Pub. Date: Aug. 21, 1997

(30) Foreign Application Priority Data

Feb. 15, 1996 (GB) ..... 9603196

(51) Int. Cl.[7] ..... H01P 3/12
(52) U.S. Cl. ..... 333/250; 333/254
(58) Field of Search ..... 333/250, 254, 333/260; 455/327, 328

(56) References Cited

U.S. PATENT DOCUMENTS

| | | | | |
|---|---|---|---|---|
| 4,480,336 | * | 10/1984 | Wong et al. | 455/328 |
| 4,641,369 | * | 2/1987 | Grote et al. | 455/327 |
| 4,811,426 | * | 3/1989 | Pergande | 455/327 |
| 5,062,149 | * | 10/1991 | Hulderman et al. | 455/327 X |

OTHER PUBLICATIONS

Cardiasmenos et al., "A 94 GHz Balanced Mixer Using Suspended Substrate Technology", IEEE MTT–S International Microwave Symposimum Digest, May 1979.*

Hayt and Kemmerly, Engineering Circuit Analysis, 3rd edition, McGraw–Hill, New York, NY, pp. 135–136, 1978.*

Lucyszyn et al., "0.1 THz Rectangular Waveguide on GaAs Semi–Insulating Substrate". *Electronic Letters,* vol. 31, No. 9, Apr. 27, 1995, pp. 721–722.

McGrath et al., "Silicon Micromachined Waveguides For Millimeter–Wave and Submillimeter–Wave Frequencies", *IEEE Microwave and Guided Wave Letters,* vol. 3, No. 3, Mar. 1993, pp. 61–63.

Patent Abstracts of Japan, vol. 11, No. 83, Mar. 13, 1987, JP 61–238104 (Nippon Telegraph & Telephone Corp.) Oct. 23, 1986.

Clifton et al., "Cooled Low Noise GaAs Monolithic Mixers at 110GHz", 1981 IEEE MTT–S International Microwave Symposium—digest, pp. 444–446.

Laurinavicius et al., "Electromagnetic Radiation Control In Metallic Waveguide With Gyrotropic Semiconductor Wall", *International Journal of Infrared and Millimeter Waves,* No. 15, No. 7, Jul. 1, 1994, pp. 1205–1209.

* cited by examiner

*Primary Examiner*—Justin P. Bettendorf
(74) *Attorney, Agent, or Firm*—Seidel, Gonda, Lavorgna & Monaco

(57) ABSTRACT

A waveguide structure is fabricated by patterning active elements on a semiconductor wafer (21). The upper surface of the wafer (21) and the active elements are then coated by a dissolvable positive resist polymer. The polymer is etched using conventional techniques to produce a former for the structure of die waveguide channel and subsequently the polymer former is coated (26) and electroformed (27) using a suitable metallic material. Finally, the polymer former is dissolved leaving an open channel (25) the boundaries of which are defined by the electroformed stucture. The waveguide structure has the advantage that die active elements are integral with the waveguide structure and lie in a common fabrication plane which means that if the depth of the waveguide varies the active elements remain in the same plane. The waveguide structure is particularly suited for use at terahertz frequencies.

9 Claims, 3 Drawing Sheets

INTEGRAL WAVEGUIDE STRUCTURE AND SEMICONDUCTOR WAFER

FIELD OF THE INVENTION

The present invention relates to waveguide structures and a method of fabrication thereof and in particular waveguide structures for use with terahertz signals.

BACKGROUND OF THE INVENTION

Conventional waveguide structures, which have been fabricated for signals up to around 600 GHz, comprise a discrete planar diode mounted on a microstrip of active components which in turn is 1o mounted on a separately fabricated support. Difficulties have been encountered though in scaling down such structures for higher frequency signals due to limitations encountered in mounting the diode on the microstrip and the parasitic capacitive effects resulting from the diode chip/microstrip combination.

BRIEF DESCRIPTION OF THE DRAWINGS

The present invention seeks to provide waveguide structures which addresses the limitations and difficulties encountered with those currently available and to provide waveguide structures suitable for use with frequencies in the range 50 GHz–10 THz and preferably 800 GHz–10 THz.

The present invention provides a method of fabricating a hollow metallic structure comprising coating an upper surface of a substrate in an etchable polymeric material, etching the polymeric material to produce a former, coating the surface of the former with a metallic material, and thereafter dissolving the polymeric material to produce a hollow metallic structure.

Figure 1A:
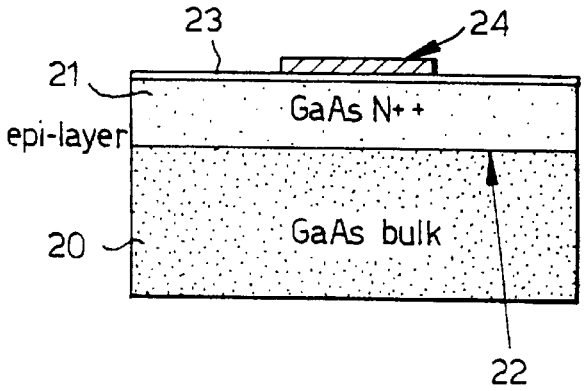
Figure 1B:
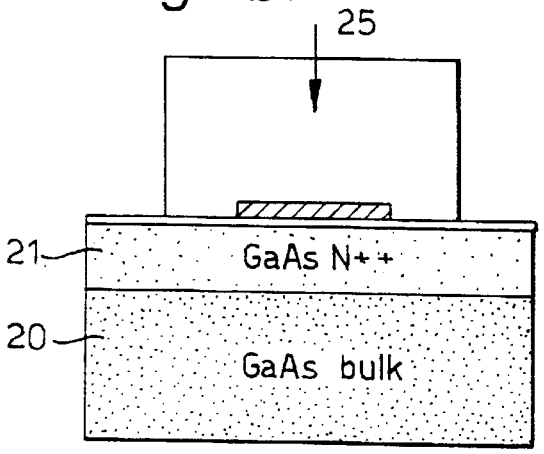

In a preferred embodiment, the method is used to fabricate a waveguide structure, wherein one or more solid state electronic components are fabricated on the substrate before the substrate and the electronic components are coated in the polymeric material, whereby the resultant hollow metallic structure has the one or more solid-state electronic components positioned distant from the base of the hollow structure on a common fabrication plane.

Waveguide channels are formed by joining two hollow structures together to form the channel. Thus, with the present invention waveguide channels may be formed integrally with one or more solid-state electronic waveguide components and at the dimensions needed for use at frequencies in the range 50 GHz–10 THz. The method also enables a waveguide channel to be formed immediately adjacent electronic components so that the electronic components are suspended over the channel in the waveguide structure. Also, as semiconductor wafer fabrication techniques are used this enables the waveguide structures to be mass produced.

Differences in height of the required waveguide circuitry is compensated for as the polymer not the substrate is processed which means that there is a common fabrication plane for the solid-state electronic devices. Moreover, this allows complete integration of components operating at different frequencies on the same wafer.

As the waveguide channel is split in the described plane, removal of the polymeric material is simplified and the electronic components can be suspended in air.

Preferably, an etch stop layer is formed in the wafer so that when the rear of the wafer is etched the etching is prevented from extending into the electronic components previously fabricated. Also, additional components may be formed on the rear of the wafer after etching of the bulk wafer material.

In addition, the polymeric former may be coated in a thin layer of a metal such as gold before electroforming of the metallic structure is performed. The polymeric material is preferably patternable such as photoresist or PMMA.

In a further aspect the present invention provides a waveguide structure comprising one or more waveguide channels having one or more solid-state electronic components on a semiconductor wafer formed integrally therewith. Ideally, both the one or more waveguide channels and the one or more solid-state electronic components lie in a common plane which is the fabrication plane of the semiconductor wafer. The waveguide structures may be used as sub-harmonic mixers, oscillators, multipliers, amplifiers or detectors, amongst others.

Ideally the waveguide structure is adapted for use with frequencies in the range 50 GHz–10 THz. Preferably, the one or more solid-state electronic components are positioned immediately adjacent and are suspended within the one or more waveguide channels. The waveguide structure may comprise at least two waveguide channels both lying in the fabrication plane of the wafer and arranged at 90° or 180° with respect to one another. Also, one or more of the waveguide channels may extend to at least one edge of the wafer whereby the one or more channels may be brought into communication with channels formed in further wafers.

BRIEF DESCRIPTION OF THE DRAWINGS

This configuration is also particularly suited to the formation and use of microstrip circuitry.

Figure 1C:
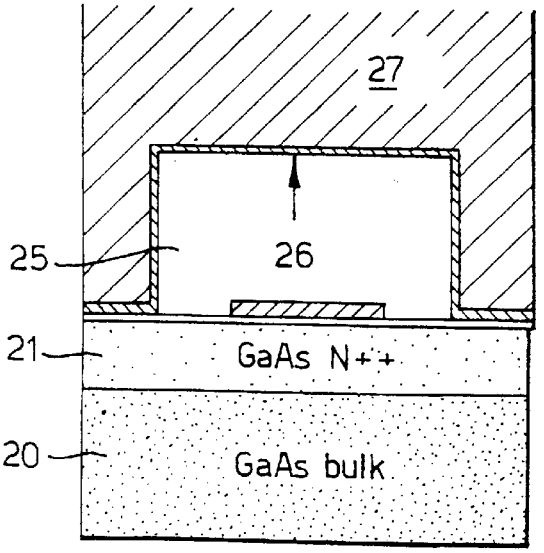
Figure 1D:
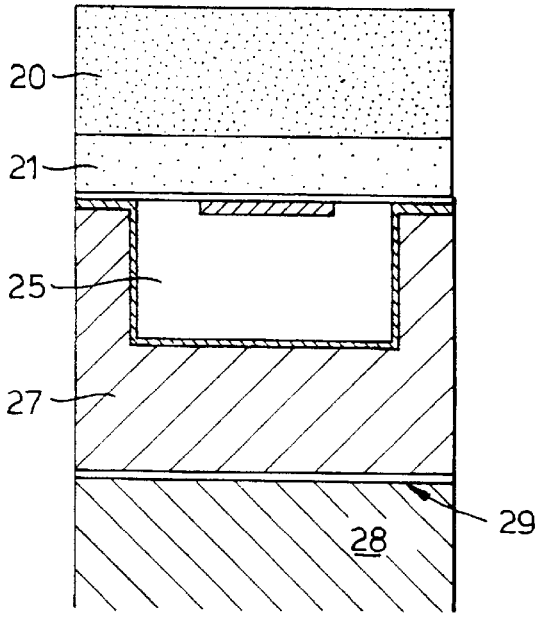
Figure 1E:
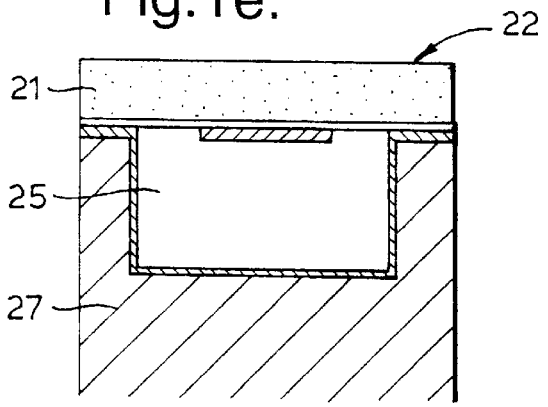
Figure 1F:
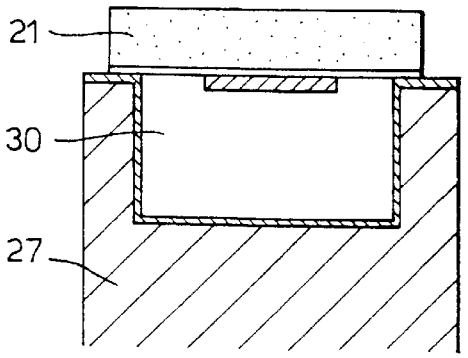
Figure 2:
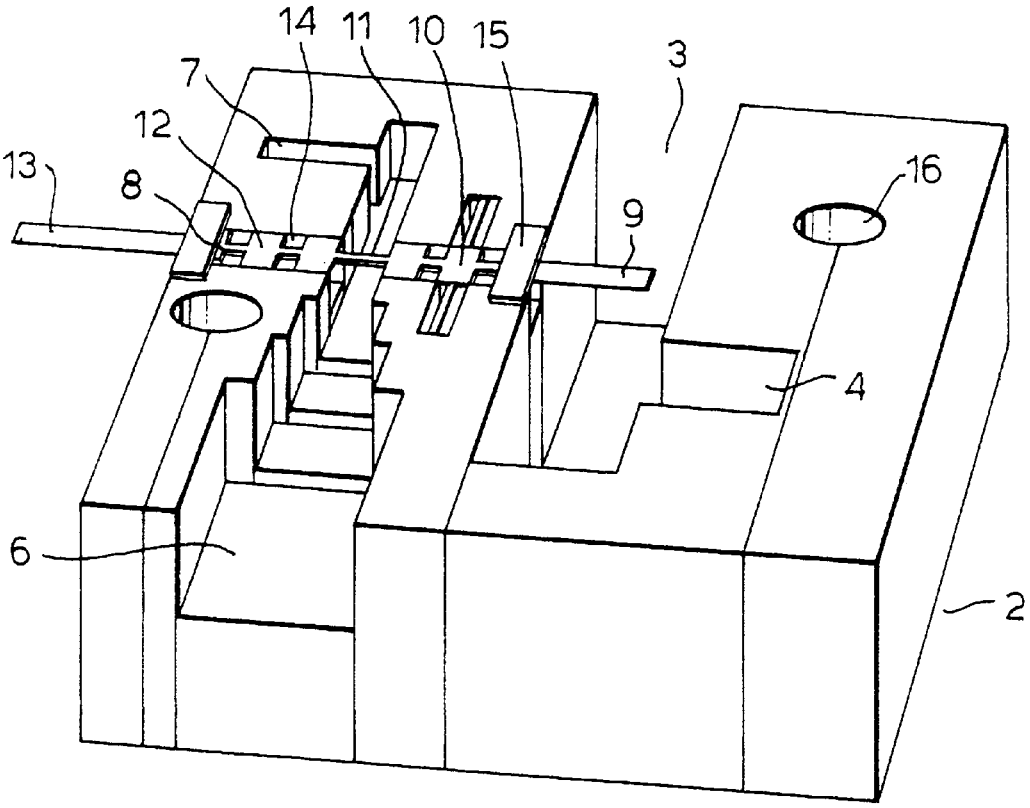

An embodiment of the present invention will now be described by way of example with reference to the accompanying drawings: in which:

FIGS. 1*a* to 1*f* show diagramatically a method of fabrication of a waveguide structure in accordance with the present invention; and FIG. 2 is a diagram of a waveguide structure fabricated in accordance with the present invention.

DETAILED DESCRIPTION OF THE INVENTION

With reference to FIG. 1*a* to 1*f* a method of fabricating active components integrally with a waveguide structure is shown. A substrate in the form of a standard wafer 20 of a semiconductor material such as GaAs has a doped layer GaAsN++ 21 formed on its upper surface over an etch stop layer AlGaAs 22. Patterning of diodes or other solid-state electronic components 23 along with formation of Ohmic contacts and filter metalisation 24 are performed using conventional techniques in the doped layer 21 of the wafer (FIG. 1*a*).

The wafer is then coated in a dissolvable polymer such as Hoescht AZ 4000 series resist (positive resist) which is etched (FIG. 1*b*) using any one of the variety of techniques available such as laser ablation, x-ray lithography, ultraviolet lithography or reactive ion etching (RIE) to provide a former 25 which lies in the fabrication plane of the wafer and is in the shape of the channel or other waveguide structure required. The former 25 is then sputter coated 26 with gold for example and electroformed 27 using copper or nickel or any other suitable metallic material to a thickness sufficient to provide mechanical support (FIG. 1*c*).

The wafer is then mounted with its rear face upwards on a sacrificial substrate 28 preferably using a soluble glue 29

(FIG. 1*d*). The backside of the wafer is now processed by the chemical removal of the bulk semiconductor 20 down to the etch stop layer 22 using any conventional technique (FIG. 1*e*). Finally the polymer former is dissolved out using an organic solvent such as acetone which is introduced to the surfaces of the resist exposed through gaps in the metallisation. The removal of the polymer former produces an open channel 30 the boundaries of which are defined by the electroformed waveguide structure. The doped layer 21 is also patterned and regions removed along with the etch stop layer 22, as necessary (FIG. 1*f*). It will be appreciated that the provision of the etch stop layer 22 simplifies the etching of the bulk semiconductor material in view of the thicknesses involved.

Thus, with the method described above, both the front and rear surfaces of the semiconductor wafer are worked to fabricate the three-dimensional structures needed. This, in addition, enables the fabrication of structures where bulk semiconductor material is needed on both sides of the waveguide structures. Moreover, with this method the waveguide channel topographies which may be of varying height are formed integrally with the solid-state electronic components and in a common plane being the fabrication plane of the wafer by the fabrication of formers which are electroformed before being removed thereby enabling the solid-state electronic components to be suspended within the former spaces. It will of course be apparent that any conventional fabrication techniques for the formation of the solid-state electronic components may be employed with the method described above. As conventional semiconductor wafer techniques are employed, mass production of the waveguide structures may be easily and cheaply performed unlike conventional manual techniques.

Of course this technique may also be employed to construct the walls of the waveguide structure using either positive or negative resist polymer as a permanent structure for the walls of the waveguide. In this case the polymer former is coated in a suitable metallic material and is used as the supporting structure instead of being dissolved away subsequently as described in the above example. This structure has the disadvantage that the electronics are located at the base of the channel, rather than in the centre as in the previous example. This in turn introduces problems in aligning different waveguide elements where the channel size varies.

In FIG. 2 an integral waveguide structure fabricated from a semiconductor wafer, using the method described above, is shown in the form of half of a sub-harmonic mixer 2. The mixer 2 has a low frequency carrier waveguide channel 3 with a tuning channel 4 adjacent its end and a stepped RF input waveguide channel 6, also with a tuning channel 7, at 180° to the carrier waveguide channel 3. Both the carrier waveguide channel 3 and the input waveguide channel 6 lie in the same plane which is the fabrication plane of the wafer unlike conventional waveguides which usually have the waveguide channels positioned at 900 to one another. The carrier and input waveguide channels are also open to the upper surface of the wafer. This allows easy removal of the polymeric material through dissolution or etching. It will be appreciated that it is not necessary for all the polymer to be removed, although that is preferred. It is only necessary for a substantial portion to be removed especially where the polymer is less lossy at RF frequencies In addition, the carrier waveguide channel 3 and the input waveguide channel 6 are open at the edges of the wafer. In this way the channels may be brought into communication with extensions of the channels and alternative active components such as a signal generator provided on separate wafers or indeed the same wafer.

The electronic components for combining the two signals respectively received in the carrier waveguide channel 3 and the input waveguide channel 6 are in the form of a microstrip 8 which also lies in the fabrication plane of the wafer and is fabricated with the channels on the semiconductor wafer by the method described above. The microstrip 8 consist of a low frequency probe 9 which is connected to a low frequency is filter 10. An RF probe 11 is also provided connected to an intermediate frequency filter 12 which in turn is connected to an intermediate frequency output 13. The low frequency probe 9 which is in communication with the RF probe 11, projects into the carrier waveguide channel 3 whereas the RF probe 11 extends across the input waveguide channel 6. As may be seen in FIG. 2 the microstrip 8 is located in a mixing channel 14 which at least connects the two waveguide channels 3,6 to the signal output. The microstrip 8 is suspended in air within the mixing channel 14 from insulating supports 15 which extend across the width of the mixing channel. Holes 16 are also provided to enable the second half of the sub-harmonic mixer (not shown) to be accurately positioned over the structure described above.

The second half of the sub-harmonic mixer, also formed on a wafer, mirrors the arrangement of channels of the first half of the mixer described above but has pegs in the place of the holes 16. When in use the pegs of the second half of the sub-harmonic mixer are aligned and engage with the holes 16 in the first half of the mixer so that the channels in the second half of the mixer are aligned with the channels in the first half of the mixer thereby forming conduits each of which is open to at least one edge of the two wafers and within one of which the microstrip 8 is enclosed. As the microstrip 8 is suspended in air within one of the conduit parasitic capacitance effects can be reduced to acceptable levels.

Although a sub-harmonic mixer has been described above it will be appreciated that alternative structures can also be fabricated by the method described such as oscillators, multipliers, amplifiers and detectors with the active components formed integrally with the waveguide or other channel structures and, where necessary, with the electronic components suspended within the channel structures formed on the wafer.

What is claimed is:

1. A waveguide structure comprising a pair of metallic channels, each fabricated from a metalised etched polymeric former, and a semiconductor wafer having one or more solid-state electronic components on a first surface wherein the first surface of the semiconductor wafer also has a metallic coating on a region of the surface between the one or more solid-state components and an edge of the wafer said coating being continuous with metal forming one of the metallic channels whereby said semiconductor wafer is suspended across opposing walls of the metallic channel and wherein said pair of metallic channels are dimensioned so as to be suitable for use in the frequency range 50 GHz to 10 THz and are secured together to form a waveguide conduit in which said one or more solid-state components are suspended.

2. A waveguide structure as claimed in claim 1 wherein a plurality of solid-state electronic components are provided which lie in a common plane being the fabrication plane of the semiconductor wafer.

3. A waveguide structure as claimed in claim 2, where said pair of metallic channels lie in a common plane being the fabrication plane of the semiconductor wafer.

4. A waveguide structure as claimed in claim 2, where at least one of the metallic channels extends to an end of the semiconductor wafer.

5. A waveguide structure as claimed in claim 1 wherein said a pair of metallic channels have a common plane of symmetry being the fabrication plane of the semiconductor.

6. A waveguide structure as claimed in claim 5 wherein said pair of metallic channels includes a mixing channel that intersects the waveguide conduit in which said one or more solid-state electronic components are suspended.

7. A waveguide structure as claimed in claim 6, where at least one of the metallic channels extends to an end of the semiconductor wafer.

8. A waveguide structure as claimed in claim 5, where at least one of the metallic channels extends to an end of the semiconductor wafer.

9. A waveguide structure as claimed in claim 1 wherein at least one of the metallic channels extends to an end of the semiconductor wafer.

* * * * *